US007458836B2

(12) United States Patent
Adams

(10) Patent No.: US 7,458,836 B2
(45) Date of Patent: Dec. 2, 2008

(54) THREE-WAY TO ONE-WAY LIGHT BULB ADAPTOR

(76) Inventor: Albert E. Adams, P.O. Box 226, Lyndonville, VT (US) 05851

( * ) Notice: Subject to any disclaimer, the term of this patent is extended or adjusted under 35 U.S.C. 154(b) by 0 days.

(21) Appl. No.: 11/940,737

(22) Filed: Nov. 15, 2007

(65) Prior Publication Data

US 2008/0113541 A1 May 15, 2008

Related U.S. Application Data

(60) Provisional application No. 60/859,316, filed on Nov. 15, 2006.

(51) Int. Cl.
*H01R 33/08* (2006.01)

(52) U.S. Cl. ..... 439/236; 362/457; 439/241

(58) Field of Classification Search ..... 362/418, 362/441, 457, 458, 650; 439/236, 241
See application file for complete search history.

(56) References Cited

U.S. PATENT DOCUMENTS

| | | | | | |
|---|---|---|---|---|---|
| 1,187,723 | A | * | 6/1916 | George | 439/168 |
| 2,788,504 | A | * | 4/1957 | Hertel | 439/628 |
| 4,842,556 | A | * | 6/1989 | Vogel | 439/638 |
| 5,113,044 | A | * | 5/1992 | Tomberlin | 200/51.04 |
| 5,608,195 | A | * | 3/1997 | DeMotte | 200/50.28 |

* cited by examiner

*Primary Examiner*—Briggitte R Hammond
(74) *Attorney, Agent, or Firm*—Daniel S. Coolidge

(57) ABSTRACT

An electrical contact modifier is configured to allow the use of a "single-element" medium base light bulb in a three-way lamp holder/switch. The device allows the three-way switch to replicate the "OFF-ON" functionality of a standard one-way light switch.

1 Claim, 2 Drawing Sheets

THREE-WAY TO ONE-WAY LIGHT BULB ADAPTOR

This application claims priority from provisional application 60/859,316 filed Nov. 15, 2006.

FIELD OF THE INVENTION

The invention relates to electric light fixtures, and more particularly to three way bulbs and sockets.

BACKGROUND OF THE INVENTION

There is a desire on the part of many consumers to use a "single-element" bulb in a three-way light fixture. For example, many ecologically-minded persons prefer to use the more efficient compact fluorescent bulbs in place of traditional wire filament incandescent bulbs. Three-way versions of compact fluorescent bulbs are difficult to find and expensive. In other cases, a consumer may wish to have only a single level of illumination from a lamp fitted with a three-way light socket.

A three-way socket has a common connection, usually all or part of the threaded portion of the base receptacle. Additionally, there are two connections in the bottom of the base designed to connect, respectively, a tip connection and a ring connection on the three-way bulb. In the off (or first) position of the power switch, no power is sent to any connection. In the second position, power is sent to the ring, thus making a powered connection through the lighting element to the common connection. In the third position, power is provided to the tip connection, and not to the ring, thus lighting a second element typically of higher power. In the fourth position, power is provided to both the ring and the tip, thus giving the combined light output of both the bulb-lighting elements.

A "single-element" (or one-way) bulb has no ring connection. A problem with using a single-way (one level of illumination) bulb in a three-way socket is that as the power switch is turned, the illumination pattern will be off-off-on-on rather than the desired off-on. This can be a nuisance.

What is needed is a simple, consumer-friendly device that will adapt a three-way light socket to operate a "single-element" bulb in the desired of-on configuration.

BRIEF DESCRIPTION OF THE INVENTION

An object of the present invention is to provide a means of modifying a three-way lamp holder/switch to accommodate a "single-element" compact fluorescent or other type of medium-base light bulb, using a simple, durable device that can fit within the confines of a typical three-way household lamp without compromising utility or safety, while at the same time duplicating the functionality of an "OFF-ON" type of switching system.

A disc shaped button adapter for insertion into a three-way lamp socket is made from a disc of non-conductive material with a notch in the disc designed to fit over the ring connection of a three-way bulb socket. The disk has a connector means which connects the three-way bulb ring connector to a tip connector on a one-way bulb when the disc adapter is inserted into a three-way bulb socket and a one-way bulb is then inserted into the same socket. The disc adapter electrically isolates the tip connector of the three-way lamp socket.

DETAILED DESCRIPTION

A "single-element" light bulb, for the purposes of this document, refers to one which is capable of a single level of illumination when energized. Any type of medium-base light bulb could be used. However, a need exists to utilize compact fluorescent lamps (CFLs) and LED bulbs.

A three-way lamp holder/switch is often found in many table and floor lamps. When combined with what is typically an incandescent three-way light bulb, three levels of illumination are produced by the lamp. The standard three-way lamp holder has four switch positions: off, low, medium, and high. By utilizing the outside of the light bulb's screw-in base as a common electrical ground, with two concentric electrical contacts (called, respectively, tip and ring) on the bulb's male base, the three-way lamp holder enables independent or simultaneous activation of the two separate filaments within the incandescent bulb.

A commonly used three-way incandescent bulb is rated at 50-100-150 watts of electrical consumption and proportional illumination. With the increasing costs of excessive electrical power consumption, more attention is being paid to the benefits of replacing incandescent light bulbs with energy-efficient ones. The major advantage of the compact fluorescent bulb over its incandescent equivalent is that it typically uses approximately 25% of the electricity consumed by the incandescent bulb for the same amount of light output.

It is possible, if not always easy, to find three-way compact fluorescent light bulbs. Anecdotal evidence suggests that there may be technical issues with the current generation of these bulbs, which would account for the difficulty sometimes encountered with finding them. The high cost of these bulbs may also tend to depress demand, and their subsequent availability.

When a "single-element" compact fluorescent or incandescent type of light bulb is used in a three-way lamp holder/switch, the sequence of illumination when rotating the switch's activating knob is "OFF-OFF-ON-ON," which can be annoying to a consumer. This invention modifies that sequence to the more conventional "OFF-ON-OFF-ON".

Figure 2:
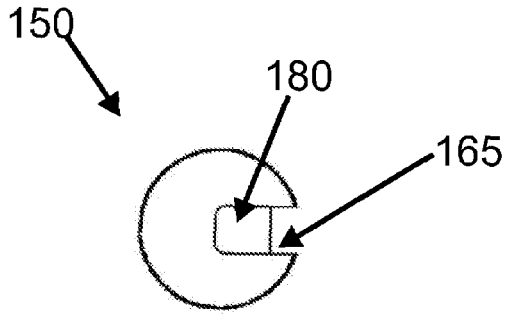
FIG. 2 is a top-down view of a three-way to one-way bulb button adapter.
Figure 1A:
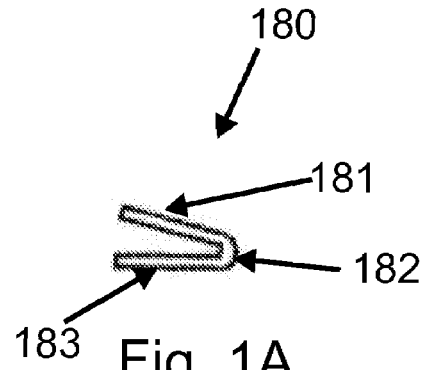
FIG. 1 is a side view of a three-way to one-way bulb button adapter.
Figure 1:
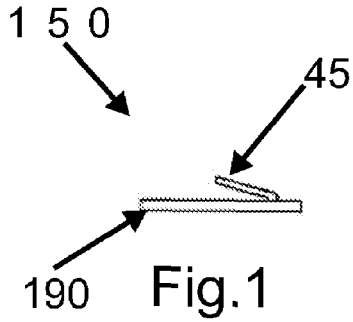

Referring to FIG. 1, a side view of a button adapter 150 is shown. The adapter 150 is of a circumference designed to fit snugly into a standard three-way lamp socket. It has a body 190 made of a non-conductive stiff insulating material, such as high-temperature plastic or cardboard. As shown in FIG. 2, the adapter 150 has an index slot 165 to hold it in position over the ring connector 160 of a bulb base as shown in FIG. 2A.

Figure 1B:
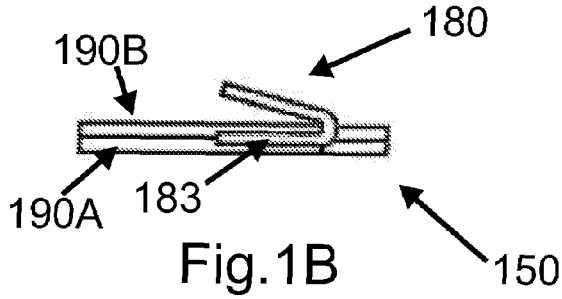

Referring to FIG. 1A, an adapter connector means 180 part of the button adapter is shown disassembled from the button adapter. The adapter connector means 180 is made from a strip of conductive material bent into a roughly "J" shape, having a tip contact portion 181, a ring contact portion 182 and a neck portion 183. As shown in cutaway FIG. 1B, when assembled the neck portion 183 is sandwiched between the bottom 190A and top 190B of the body 190. The body may be made of two pieces as shown, or it may simply be of a material such as cardboard which is split so as to receive the neck portion 183 of the adapter connector means 180.

Figure 2A:
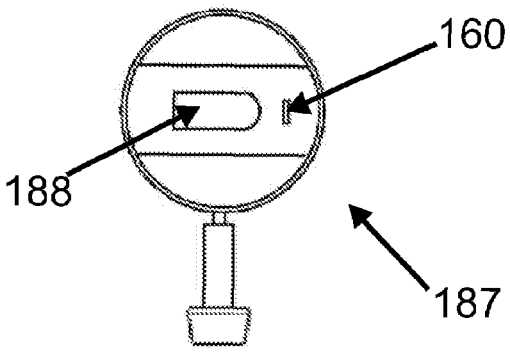
FIG. 2A is a top-down view of a standard three-way bulb socket (prior art).
Figure 3:
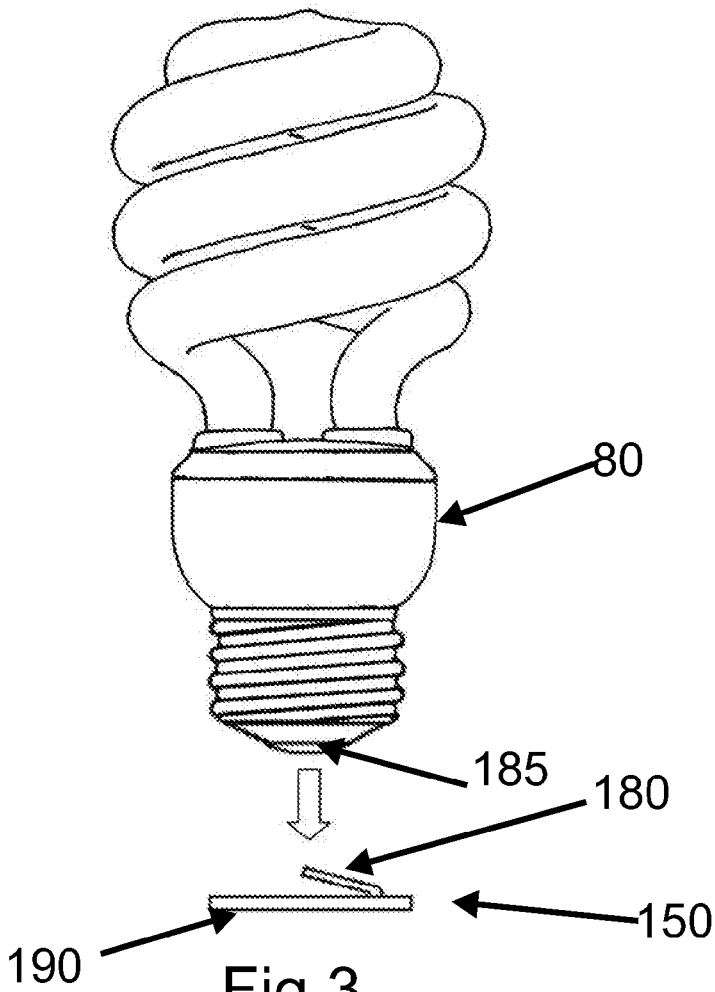
FIG. 3 is a side view of a one-way bulb positioned above a button adapter.
Figure 3A:
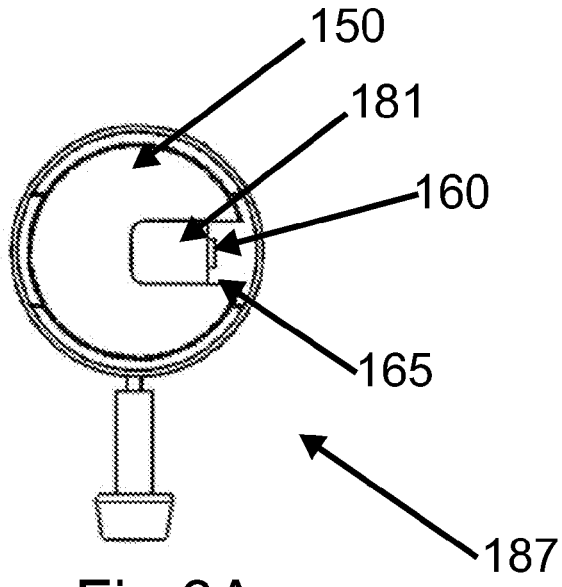
FIG. 3A is a top-down view of a three-way to one-way bulb button adapter in place in a standard three-way bulb socket.

Thus, as shown in FIG. 2, on the top of the button adapter 150 the adapter connector means 180 is an electrically conductive contact designed to mate at the ring contact portion 181 with a ring connection 160 of a three-way lamp base 187 shown in top view in FIG. 2A (prior art) and with the tip contact 185 of a bulb 180 (prior art). Thus, as shown in FIG. 3A, when the button adapter 150 is inserted into a three-way lamp base 187 the adapter connector means 180 electrically connects through the ring contact portion 182 a ring contact 160 of a three-way lamp base 187, then through the tip contact portion 181 to a tip contact 185 of a one-way light bulb 80. The tip contact of the lamp base 188 is electrically isolated. As shown in FIGS. 2 and 3, the tip contact portion 181 of the adapter connector means 180 is in position so as to connect to a bulb tip contact 185 on a bulb 80. Fig 3A shows a top view of a lamp base 187 showing the adapter 150 in place. As may be seen, the index notch 165 seats over the lamp base ring connector 160 electrically contacting the adapter ring contact portion 182 to the lamp base ring connector 160.

Modifications and substitutions by one of ordinary skill in the art are considered to be within the scope of the present invention, which is not to be limited except by the following claims.

I claim:

1. A three-way to one-way light socket button adapter comprising a nonconductive disc-shaped body comprising an upper portion and a lower portion, said body being substantially circular and adapted so as to fit snugly into a three-way light bulb socket;

said body further having a center;

said adapter further comprising adapter connector means, said adapter connector means having a tip contact portion, a ring contact portion and a neck portion;

said adapter further comprising a generally rectangular index notch adapted so as to fit over a ring connection in a three-way light bulb socket; said index notch having an inner edge;

said neck portion being inserted between said upper portion and said lower portion of said body, said neck portion being positioned such that the ring contact portion as adjacent to said inner edge of said inner edge of said index notch and said tip contact portion protrudes above said body from said ring contact portion toward said center of said body;

said index notch edge is a distance from the said center of said body such as will cause said ring contact portion of said adapter connector means when positioned in a three-way lamp socket to make electrically connect to a ring contact in a three-way lamp socket.

* * * * *